US005181637A

United States Patent [19]

Santilli

[11] Patent Number: 5,181,637

[45] Date of Patent: Jan. 26, 1993

[54] COMBINATION NAIL BAG AND OPEN TOP CONTAINER

[76] Inventor: Joseph Santilli, 1221 Frontage Rd., Chula Vista, Calif. 92011

[21] Appl. No.: 700,217

[22] Filed: May 6, 1991

[51] Int. Cl.[5] ..... B65D 83/00; A45F 5/00

[52] U.S. Cl. ..... 224/196; 224/252; 206/338

[58] Field of Search ..... 224/252, 224, 226, 268, 224/269, 904, 196, 225, 253; 383/33; 206/338; 220/501; 248/101

[56] References Cited

U.S. PATENT DOCUMENTS

| | | | |
|---|---|---|---|
| 302,446 | 7/1884 | Taylor | 224/226 |
| 539,970 | 5/1895 | Williamson | 224/226 |
| 1,290,405 | 1/1919 | Suter | 248/101 |
| 1,345,864 | 7/1920 | Lethern | 224/196 |
| 1,374,451 | 4/1921 | Heyman | 206/338 |
| 1,416,690 | 5/1922 | Cohen | 383/33 |
| 2,766,918 | 10/1956 | Evanguelidi | 224/196 |
| 3,342,387 | 9/1967 | Ryan | 224/252 |
| 4,069,965 | 1/1978 | Maddox, Jr. | 248/101 |
| 4,069,994 | 1/1978 | Wharmby | 248/101 |
| 4,971,274 | 11/1990 | Mitchell | 248/101 |

*Primary Examiner*—Henry J. Recla
*Assistant Examiner*—Robert M. Fetsuga
*Attorney, Agent, or Firm*—Charles C. Logan, II

[57] ABSTRACT

A combination nail bag and open top container that would be used by a carpet installer. The open top container would normally have a front wall, laterally spaced side walls and an open rear wall. The nail bag has an open top end that is detachably secured to the rear end of the open top container. The carpet nails would be freely transferable between the interior of the nail bag and the interior of the open top container by passing through its open rear wall. A clip assembly secured to the rear surface of the nail bag allows it to be detachably secured to the belt of a carpet installer.

4 Claims, 2 Drawing Sheets

COMBINATION NAIL BAG AND OPEN TOP CONTAINER

BACKGROUND OF THE INVENTION

The invention relates to carpet installation and other jobs involving the use of nails by a worker.

Presently carpet installers use the carpet nails by taking them individually from the box from which they were purchased. This box has to be periodically slid along the carpet work surface to keep the installer supplied with nails. Occasionally the carpet installer will keep the carpet nails in a pocket but this system is cumbersome and also makes holes in their pockets.

Carpenters and framers also require a considerable number of nails while performing their work. Sometime they keep the nails in a pocket of their tool-belt but this is not entirely satisfactory. When the workers take the nails directly from the box from which they were purchased, time is lost moving the box along the work area.

It is an object of the invention to provide a novel combination nail bag and open top container that can be detachably worn on the belt of a carpet installer, framer, etc.

It is also an object of the invention to provide a novel combination nail bag and open top container that allows the nails to be freely transferred from the interior of the nail bag to the inside of the open top container.

It is another object of the invention to provide a novel combination nail bag and open top container that is economical to manufacture and market.

It is an additional object of the invention to provide a novel combination nail bag and open top container formed from detachable components that allow individual components to be replaced should they become damaged.

SUMMARY OF THE INVENTION

The novel combination nail bag and open top container has been designed to be used by carpet installers, carpenters, framers, and do-it-yourself homeowners.

The combination nail bag and open top container is formed from three components and they are the open top container, an elastic band, and a nail bag.

The open top container has a neck portion formed along its rear end and its rear wall may be completely open or a major portion of it is cut away to form a passage for the nails. The nail bag has an open top end with a lip extending entirely therearound which telescope over the neck portion of the open top container. An elastic band is installed over the top end of the nail bag to detachably secure it to the rear end of the open top container. A U-shaped clip assembly may be secured to the rear surface of the nail bag by an adhesive or other fastening structure.

An alternative embodiment has a U-shaped clip assembly formed on one of the side walls of the open top container or attached thereto.

When a person using the invention needs to have the nails available for use in the open top container, he merely takes the combination structure off of his belt and raises the rear of the nail bag causing the nails to travel downwardly into the interior of the open top container. The combination structure is then clipped on the worker's belt. At the end of the job, he merely takes the combination structure off his belt and raises the open top container higher than the nail bag which causes the nails to transfer downwardly into the nail bag.

The combination nail bag and open top container structure is convenient and lightwieght. It eliminates the time consuming operation of continually moving a nail box to a new work location.

DESCRIPTION OF THE PREFERRED EMBODIMENT

The combination nail bag and open top container is generally designated numeral 10. It is formed from an open top container 12, an elastic band 14, and a nail bag 16.

Figure 1:
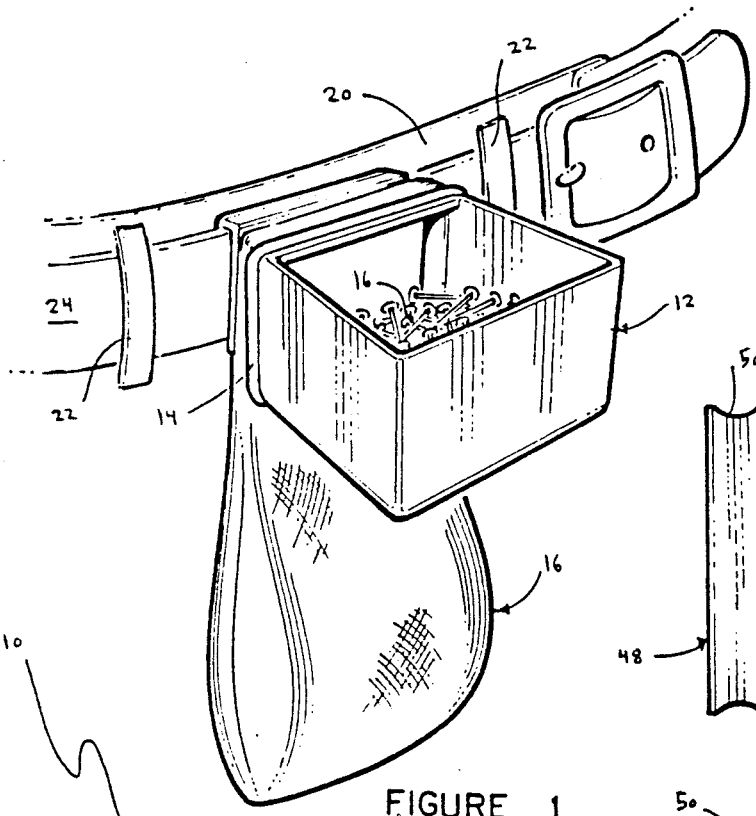
FIG. 1 is a front perspective view illustrating the novel combination nail bag and open top container installed on the belt of a worker.
Figure 2:
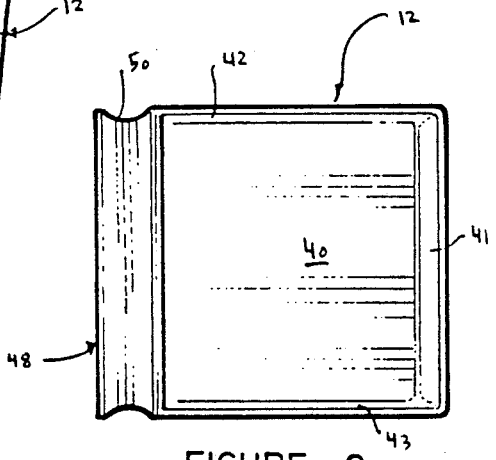
FIG. 2 is a top plan view of the open top container.
Figure 3:
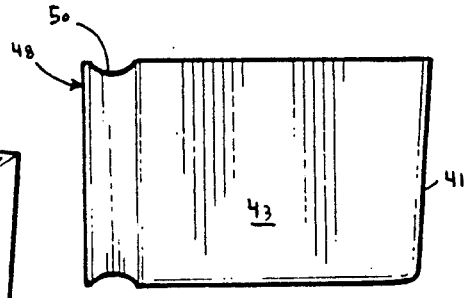
FIG. 3 is a side elevation view of the open top container.
Figure 4:
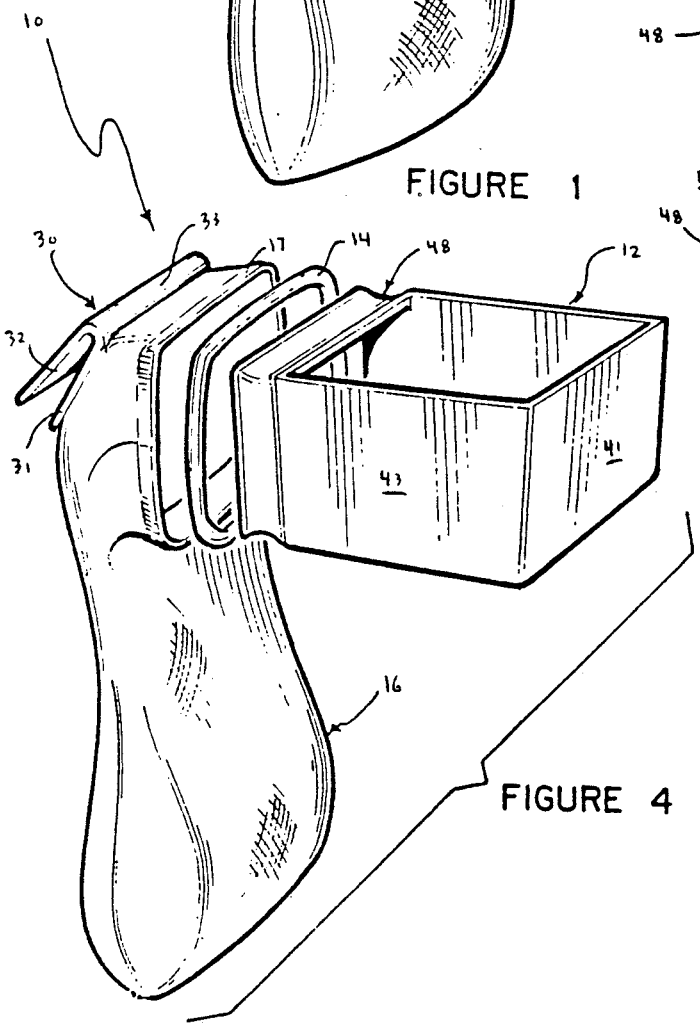
FIG. 4 is an exploded front perspective view of the combination nail bag and open top container.

In FIG. 1 the combination nail bag and open top container is show detachably installed on the clothing of a carpet installer. The installer has a pair of trousers 20 having a plurality of belt loops 22 through which a belt 24 passes. The U-shaped clip assembly 30 of the nail bag is detachably slipped over the belt 24. Alternatively it can be slipped over the top edge of the waist portion of the trousers if a belt is not worn.

Open top container 12 has a bottom wall 40, a front wall 41, and laterally spaced side walls 42 and 43. The rear wall is preferrably open and a neck portion 48 extends from the rear end of the open top container. Neck portion 48 has a top wall, a bottom wall, and side walls and they all have an annular groove extending around them.

Nail bag 16 has a lip 17 at its top end that is slid over the rear end of open top container 12. An elastic band 14 is installed over the outer surface of the top end of the nail bag so that the elastic band is oriented in annular groove 50. This allows the nails 60 to be freely transferrable between the interior of nail bag 16 and the interior of open top container 12.

The U-shaped clip assembly 30 has a front wall 31, a rear wall 32 and these two are connected together by a top connection section 33. Front wall 31 may be secured to the rear surface of nail bag 15 by adhesive material or any other type of fastening material.

Figure 5:
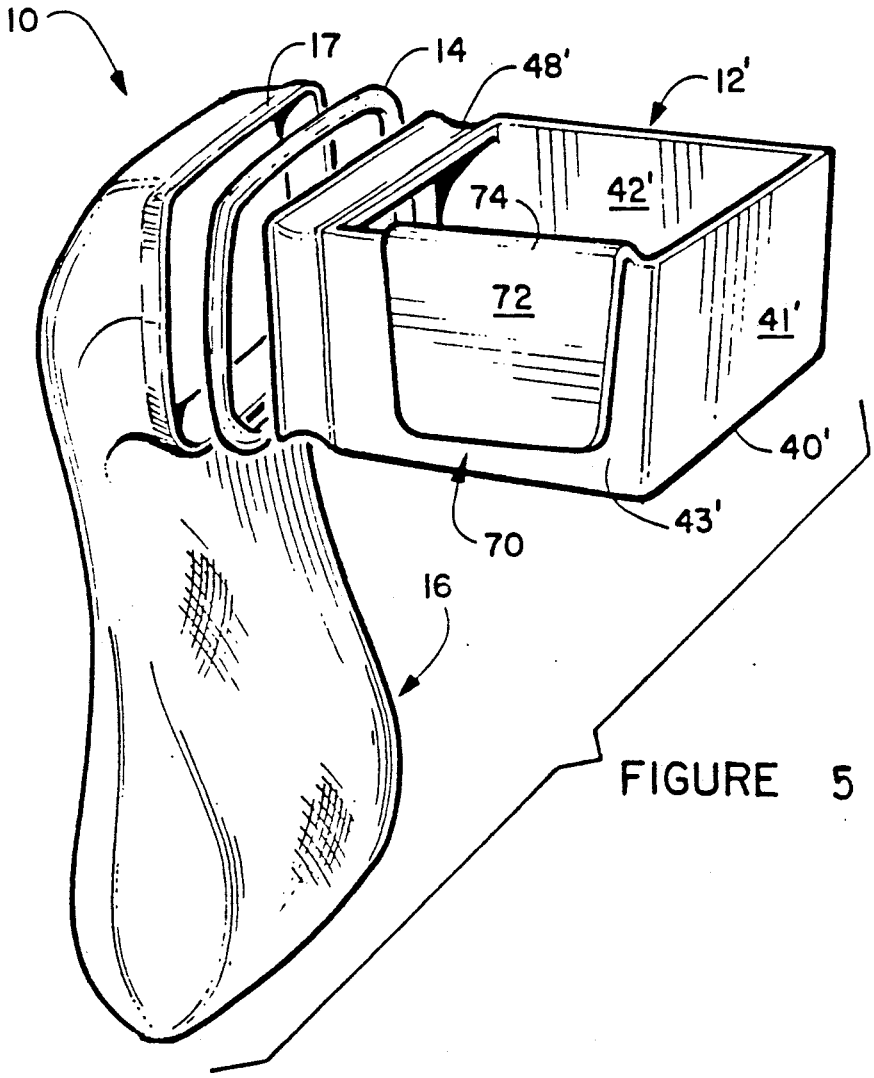
FIG. 5 is an exploded front perspective view of an alternative embodiment of the combination nail bag and open top container.

An alternative embodiment open top container 12' is illustrated in FIG. 5. It has a bottom wall 40', a front wall 41', and laterally spaced side walls 42' and 43'. The rear wall is preferrably open and a neck portion 48' extends from the rear end of the open top container. A U-shaped clip assembly 70 is formed on one of the walls of the open top container. In the embodiment shown side wall 43' forms the rear wall of U-shaped clip assembly 70 which also has a front wall 72 and a top connection section 74. It would also be possible to glue a separate clip assembly to one of the side walls of the open top container instead of forming it as an integral member of the open top container.

What is claimed is:

1. A combination nail bag and open top container comprising:

a nail bag having a closed bottom end and an open top end having a lip that extends around said open top end, said nail bag having a front surface and a rear surface;

an open top container having a front end and a rear end, said container having a bottom wall, a front wall and laterally spaced side walls, the rear end of said container having an opening;

means for detachably connecting the open top end of said nail bag over the opening in the rear end of said open top container; and a clip assembly on one of the walls of the open top container for detachably attaching said combination structure to the belt of a carpet layer.

2. The combination nail bag and open top container as recited in claim 1 wherein said means for detachably connecting the nail bag to the container comprises a closed loop elastic band that grips the lip of said nail bag to the rear end of said open top container.

3. The combination nail bag and open top container as recited in claim 2 wherein said open top container has a neck portion formed adjacent its rear end.

4. The combination nail bag and open top container as recited in claim 3 wherein said neck portion has an annular groove formed in its outer surface.

* * * * *